United States Patent [19]

Cleveland

[11] Patent Number: 4,516,778

[45] Date of Patent: May 14, 1985

[54] GOLF CLUB

[76] Inventor: Roger C. Cleveland, 7322 Madison St., Paramount, Calif. 90723

[21] Appl. No.: 476,278

[22] Filed: Mar. 17, 1983

[51] Int. Cl.[3] ..... A63B 53/04

[52] U.S. Cl. ..... 273/80.3; 273/167 H

[58] Field of Search ..... 273/80.2–80.9, 273/167 H, 169

[56] References Cited

U.S. PATENT DOCUMENTS

| | | | |
|---|---|---|---|
| Re. 16,808 | 12/1927 | Heller | 273/80.3 X |
| 1,529,009 | 3/1925 | Carpenter | 273/169 X |
| 4,432,549 | 2/1984 | Zebelean | 273/167 H |

*Primary Examiner*—George J. Marlo
*Attorney, Agent, or Firm*—Koda and Androlia

[57] ABSTRACT

A golf club head for being fitted to a shaft wherein the golf club head is a stainless steel hollow body defining a hitting surface, a top wall, a sole member, a rear wall, a pair of side walls and a neck. The golf club head is further characterized in that the neck has a first shoulder at its lower end, the neck has a cylindrical portion extending upwardly from the first shoulder, the shaft is fitted into the cylindrical portion and a plastic ferrule is mounted around the cylindrical portion such that the plastic ferrule stands on the first shoulder.

5 Claims, 4 Drawing Figures

GOLF CLUB

BACKGROUND OF THE INVENTION

1. Field of the Invention

This invention relates to a golfclub, and more particularly to a "wood" type golfclub head structure made of stainless steel.

2. Prior Art

Ever since the beginning of golf history, there have been recognized two types of golfclubs; one is called "iron" clubs which have a relatively short shaft with a small "iron" head designed to hit a golf ball accurately and the other is called "wood" clubs which have a relatively long shaft with a large "wood" head designed to hit a ball for a longer distance.

The head portion of the "wood" clubs is traditionally made of solid wood block. Until recently, persimmon was considered to be the most desirable material because of its high impact resistance and fine sound effect. In addition, golfers favored the well-balanced configuration of the traditional persimmon club heads. Particularly, the smooth tapered line in its neck portion has been highly appreciated. With these and other reasons, persimmon wood clubs substantially predominated the market for a long time.

However, as the demand for good persimmon material grew, the natural source of persimmon became scarce. As a result manufactorers find it rather difficult to satisfy all the market. In an attempt to meet the growing market demand, a number of suggestions and proposals have been made in terms of substitute for natural persimmon.

By way of example, U.S. Pat. No. 3,591,183 discloses a laminated golfclub head which is constructed of wood lamination bonded together and bent to form the angle between striding portion and hosel. U.S. Pat. No. 4,204,684 teaches the use of acrylonitrilebutadiene-styrene (ABS) and other plastic materials. U.S. Pat. No. 4,326,716 discloses a clubhead made of vulcanized polyurethane. In addition, steel made "wood" clubs have been disclosed by U.S. Pat. Nos. 3,761,095, 4,021,047, 4,139,196, 4,214,754, 4,319,752 and many others.

Among these substitute materials, stainless steel has recently acquired a significant part of the marketplace.

In general, a stainless steel "wood" club has a clubhead made of stainless steel having a basic shape similar to the conventional persimmon wood club. Its head portion includes an enclosed hollow body defining a hitting surface, a top wall, a sole member, side walls and a neck.

It has been recognized that stainless steel has certain advantages over natural persimmon, such as lower material cost, durability, and less complex finishing process. However, it has been noticed that stainless steel suffers from some disadvantages.

The most critical problem of stainless steel as a substitute for persimmon exists in its weight balance.

Stainless steel is relatively heavy in nature. Thus, it is necessary to have the walls very thin in order to maintain the same total weight as a persimmon head. On the other hand, it is required to have certain thickness to secure sufficient impact resistance and durability. In particular, since the neck portion has been considered to be weak (see U.S. Pat. No. 4,326,716, col. 2, lines 44 and 45), there is a limit to reduce the thickness of the neck portion. As a consequence, the side adjacent to the neck portion (called "heel") tends to have more weight than the other side ("toe"). This causes the center of gravity (sweet-spot) to shift toward the heel side resulting in more deflection in hitting a ball.

The existing solutions to this problem are to have the whole head portion substantially smaller than the traditional persimmon club and/or to have a straight cylindrical neck portion with its lower portions flared to be connected to the head portion as shown FIG. 1. The above solutions have cured the problem to an extent; nonetheless, those solutions have failed to construct a "wood" club head having the size and the configuration which golfers have been enjoying with the traditional persimmon heads.

Therefore, the existing stainless steel "wood" clubs have not superseded qualified persimmon wood clubs.

SUMMARY OF THE INVENTION

Accordingly, it is the primary object of this invention to provide a stainless steel "wood" club which overcomes the disadvantages contained in the prior art stainless steel "wood" clubs.

It is another object of this invention to provide a stainless steel "wood" club which has the sweet-spot in the center of the hitting surface keeping the traditional size and shape in the head portion.

It is still another object of this invention to provide a stainless steel "wood" club which is easy to play and easy to manufacture.

In keeping with the priciples of this invention, the objects are accomplished by a unique structure of the body and the neck portion of the clubhead, wherein the improvement includes the following features:

(a) the neck has a shoulder at its lower end, (b) the neck has a cylindrical portion extending upwardly from said shoulder, (c) the cylindrical portion has relatively thin and substantially even thickness in its wall, (d) a radius is provided between the cylindrical portion and the shoulder, (e) another radius is provided between the shoulder and the inside of the body, (f) a shaft is fitted into the cylindrical portion, and (g) a plastic ferrule is mounted around the cylindrical portion such that the ferrule stands on the shoulder.

BRIEF DESCRIPTION OF THE DRAWINGS

The above mentioned and other features and objects of the present invention will become more apparent by reference to the following description taken in conjunction with the accompanying drawings, wherein like referenced numerals denote like elements, and in which.

DETAILED DESCRIPTION OF THE INVENTION

Figure 1:
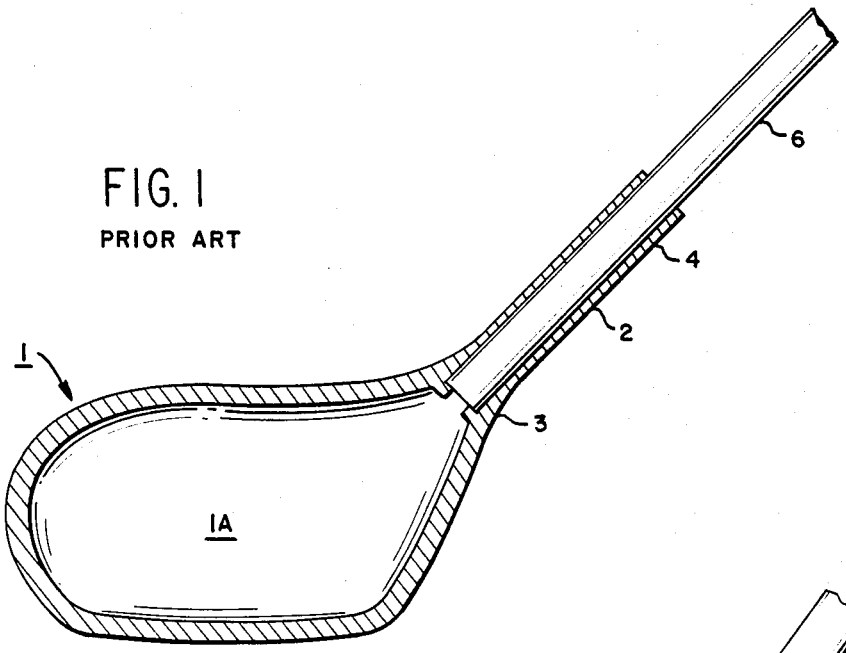
FIG. 1 PRIOR ART
FIG. 1 shows a sectional view of a prior art stainless steel "wood" club.
Figure 2:
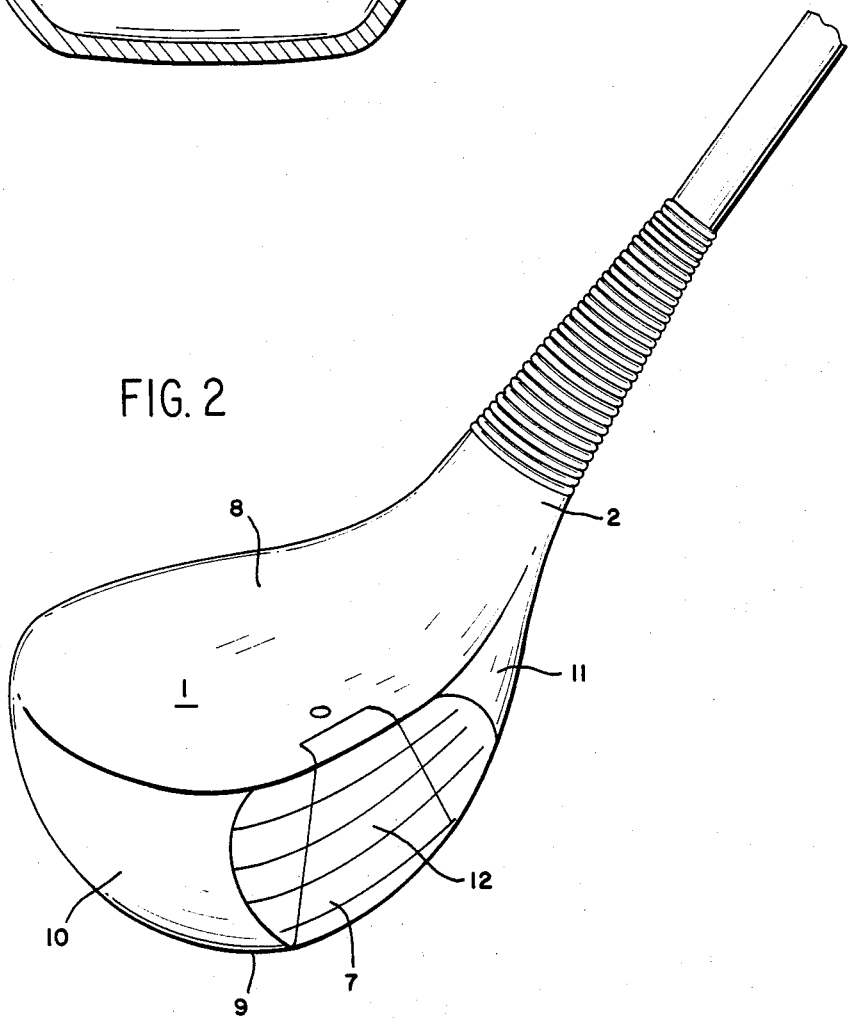
FIG. 2 shows a perspective view of a finished clubhead of this invention.
Figure 3:
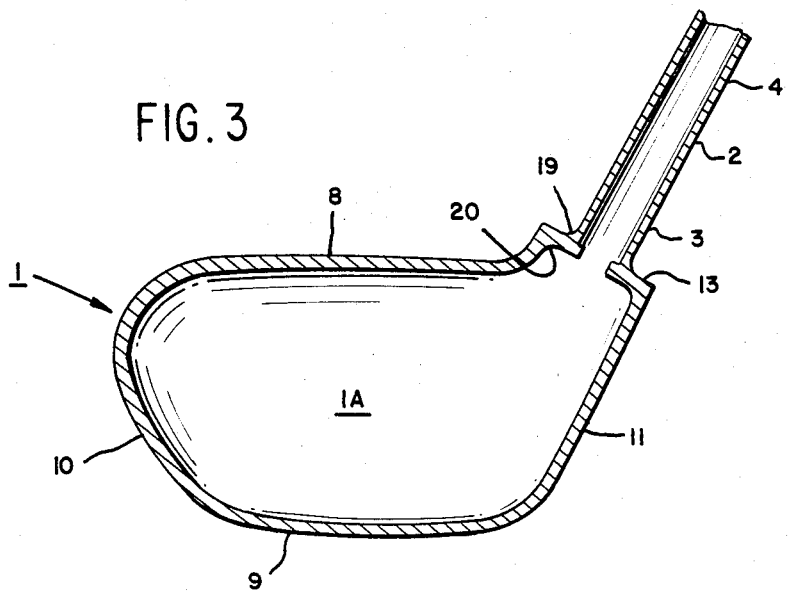
FIG. 3 shows a sectional view of a clubhead of this invention.
Figure 4:
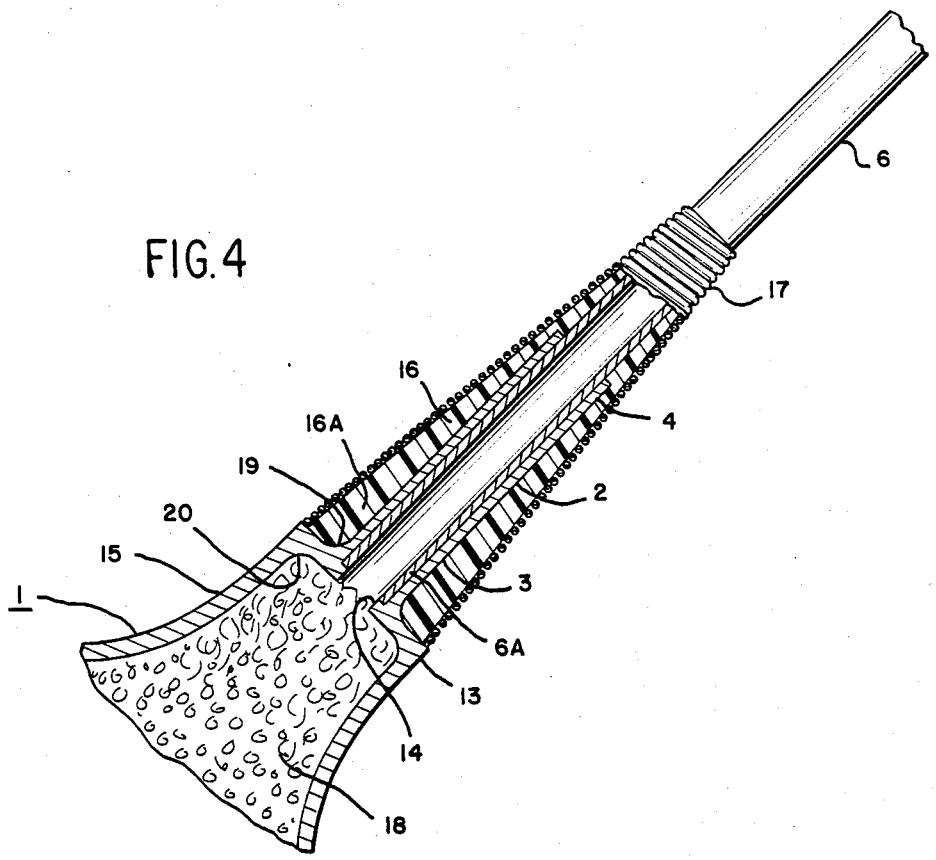
FIG. 4 shows an enlarged partial sectional view of the clubhead shown in FIG. 2.

Referring more specifically to the figures, shown in FIG. 1 is a sectional view of a prior art "wood" clubhead illustrating the general construction of existing stainless steel "wood" clubheads, shown in FIG. 2 is a perspective view of a finished clubhead in accordance with the teachings of the present invention, shown in FIG. 3 is a sectional view of a basic structure of the clubhead of this invention, and shown in FIG. 4 is a partial sectional view of the clubhead structure of this invention illustrating the interconnection of the clubhead structure of this invention.

First referring to FIG. 1 showing a prior art clubhead structure, a clubhead 1 has a substantially straight neck 2 extending upwardly from its heel side 11. A shaft 6 is fitted into and coupled to the neck 2 by means of adhesive agents such as epoxy resin.

Since the neck portion has been considered to be one of the weakest areas of the clubheads, the lower end 3 of the neck 2 has to be expanded or flared. Accordingly, the flared lower end 3 of the neck 2 has a thicker wall than the upper end 4. It has been believed that the above configuration is essential to absorb the heavy stress created at the impact when striking a golf ball, thereby avoiding cracks at the neck area.

However, according to the prior art configuration, with the addition of a traditional persimmon wood neck structure, the weight at the heel side 11 tends to be heavier than the other side resulting in having the center of gravity (sweet-spot) shifted to the heel side. As a result, golfers have been experiencing difficulty in hitting a ball accurately and farther. In order to compensate for the shift of the sweet-spot, stainless steel "wood" heads have been kept compact as in FIG. 1. In Addition, the prior art structure in the neck area shows a straight neck extending from the flared lower end which looks substantially different from the traditional persimmon clubhead having a smooth tapered line in the neck area. This invention is to provide a practical solution to this problem.

Now referring to FIG. 2 showing a finished clubhead of this invention, the general appearance of the clubhead, is the same as the traditional persimmon wood club, which is substantially larger than the prior art stainless steel "wood" clubs.

The specific configuration of the clubhead of this invention is best shown in FIG. 3. The clubhead 1 has a top wall 8, a sole member 9, a toe side wall 10, and a heel side wall 11 to form a hollow body 1A. The clubhead 1 also has a neck 2 which extends upwardly from a shoulder 13 located at the upper end of the heel side wall 11. The diameter of the neck 2 is substantially smaller than that of the shoulder 13. The neck 2 has a cylindrical shape with a relatively thin and even thickness wall from the lower end 3 to the upper end 4.

By thus constructing the clubhead, the weight balance of the clubhead may be kept as desired to have the sweet-spot 12 in the center of the hitting surface 7 (see FIG. 2). This allows golfers to hit a ball straighter and farther.

Experiments have been repeated in terms of the durability particularly at the neck area.

After a number of different types of tests, it has been observed that the thin neck and shoulder structure of this invention would not cause any more cracking or deterioration than the existing stainless steel "wood" clubs, provided that a proper material is used with the proper radiuses at the lower end 3 of the neck 2.

The thin neck and shoulder structure of this invention may properly be embodied as illustrated in FIG. 4.

The clubhead 1 is made of 17-4 Ph. stainless steel and has thickness between 0.03–0.05 inches. The neck 2 has a cylindrical wall slightly thinner than the remainder of the clubhead 1 whereby the weight balance between the heel side 11 and the toe side 10 may be very well kept to maintain the center of gravity (sweet-spot) in the desirable center 12 of the hitting surface 7 (see FIG. 2). The shaft 6 is accommodated in the neck 2 in such a manner that the tip portion 6A of the shaft 6 is in contact with a second shoulder 14 extending inwardly from the first shoulder 13.

In order to ensure a durable structure in the neck area, a radius 19 is provided between the lower end 3 and the shoulder 13 and another radius 20 is provided between the shoulder 13 and the end portion 15 of the clubhead 1. The radiuses 19 and 20 are given a curvature of 1/16"–½" and preferrably ⅛"–¼" to most effectively strengthen the structure and prevent deterioration. In addition a plastic ferrule 16 is placed to cover the neck 2 and a part of the shaft 6. The ferrule 16 is designed to specifically match the size and the shape of the shoulder 13. It is preferable to have a reinforcing string 17 wound around the ferrule 16 such that the diameter of the end portion 15 of the clubhead 1 adjacent to the neck 2 is substantially the same as the diameter of the lower end portion 16A of the ferrule 16. The ferrule 16 has a tapered shape toward its upper end so that the neck area forms a smooth and natural configuration case as the traditional persimmon wood club. Urethane foam 18 or other light materials may be inserted in the head body 1A to improve the sound effect.

As is clear from the above description, since the weight balance is well kept between the heel side 11 and the toe side 10, the center of gravity (sweet-spot) may be located in the desirable center 12 of the hitting surface 7. With this advantage and the common advantage for the stainless steel "wood" club such as wider sweet spot by added perimeter weight, the clubhead of this invention enjoys the benefit of more distance and straighter shots even with off center hits.

In all cases, it is understood that the above-described embodiments are merely illustrative of but a few of the many possible specific embodiments which represent the application of the principles of the present invention. Numerous and varied other arrangements can be readily devised by those skilled in the art without departing from the spirit and scope of the invention.

I claim:

1. A golf club comprising a head and a shaft fitted thereto, said head including a stainless steel hollow body defining a hitting surface, a top wall, a sole member, a rear wall, a pair of side walls and a neck, characterized in that, (a) said neck has a first shoulder at its lower end,
(b) said neck has a cylindrical portion extending upwardly from said first shoulder,
(c) said cylindrical portion has a relatively thin and substantially even thickness therearound,
(d) said cylindrical portion has fitted therein said shaft,
(e) a first radius is provided between said cylindrical portion and said first shoulder,
(f) a second radius is provided between said first shoulder and an inside wall of said head, and
(g) a plastic ferrule is mounted around said cylindrical portion such that said plastic ferrule stands on said first shoulder.

2. A golfclub head structure according to claim 1, wherein said ferrule is wound by a reinforcing string.

3. A golfclub head structure according to claim 1 or 2, wherein there is provided a second shoulder which extends inwardly from the first shoulder to support said shaft.

4. A golfclub head structure according to claim 1 or 2, wherein the thickness of a wall of said cylindrical portion is substantially smaller than the other portions of said clubhead.

5. A golfclub head structure according to claim 1 or 2, wherein said first and second radiusea have a curvature of 1/16"–½".

* * * * *